US008983668B2

(12) United States Patent
Ferber et al.

(10) Patent No.: US 8,983,668 B2
(45) Date of Patent: Mar. 17, 2015

(54) HOUSEHOLD APPLIANCE HAVING AN AIR DRYING DEVICE AND/OR FLUID HEATING UNIT, AND ASSOCIATED METHOD

(75) Inventors: Ulrich Ferber, Holzheim (DE); Andreas Heidel, Holzheim (DE); Helmut Jerg, Giengen (DE); Bernd Kränzle, Dischingen (DE); Kai Paintner, Adelsried (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 493 days.

(21) Appl. No.: 13/126,479

(22) PCT Filed: Oct. 20, 2009

(86) PCT No.: PCT/EP2009/063698

§ 371 (c)(1),
(2), (4) Date: Apr. 28, 2011

(87) PCT Pub. No.: WO2010/052122

PCT Pub. Date: May 14, 2010

(65) Prior Publication Data

US 2011/0213505 A1 Sep. 1, 2011

(30) Foreign Application Priority Data

Nov. 7, 2008 (DE) ..... 10 2008 056 412

(51) Int. Cl.
*G05B 11/01* (2006.01)
*G05D 3/12* (2006.01)
(Continued)

(52) U.S. Cl.
CPC ..... *D06F 58/20* (2013.01); *A47L 15/481* (2013.01)
USPC ..... 700/286; 700/21; 700/291; 134/63; 134/90; 134/105

(58) Field of Classification Search
USPC ..... 134/63, 90, 95.2, 105; 700/9, 21, 22, 700/32, 286, 291, 295, 297
See application file for complete search history.

(56) References Cited

U.S. PATENT DOCUMENTS 3,911,331 A 10/1975 Jamieson
4,649,654 A 3/1987 Hikino et al.
(Continued)

FOREIGN PATENT DOCUMENTS

CN 201087297 Y 7/2008
DE 10353775 A1 2/2005
(Continued)

OTHER PUBLICATIONS

International Search Report PCT/EP2009/063698.
(Continued)

*Primary Examiner* — Darrin Dunn
(74) *Attorney, Agent, or Firm* — James E. Howard; Andre Pallapies

(57) ABSTRACT

A household appliance, particularly a household dishwasher, washing machine, clothes dryer, or the like, includes an air drying device and/or fluid heating device, connected to an electrical energy supply network. At least one control/monitoring unit is provided to detect any deviation of an actual value of at least one characteristic of the electrical energy supply network from a target value and to generate at least one control signal for setting an electrical component of the member in response to a detected deviation of the actual value.

40 Claims, 3 Drawing Sheets

(51) Int. Cl.

| | |
|---|---|
| ***B08B 3/00*** | (2006.01) |
| ***D06F 58/20*** | (2006.01) |
| ***A47L 15/48*** | (2006.01) |

(56) References Cited

U.S. PATENT DOCUMENTS

| | | | | |
|---|---|---|---|---|
| 5,331,984 | A * | 7/1994 | Isagawa | 134/57 D |
| 5,712,554 | A * | 1/1998 | Lace | 323/259 |
| 6,363,218 | B1 * | 3/2002 | Lowenstein et al. | 392/498 |
| 7,325,333 | B2 * | 2/2008 | Tadano et al. | 34/604 |
| 7,886,810 | B2 | 2/2011 | Angermann | |
| 8,183,995 | B2 * | 5/2012 | Wang et al. | 340/539.1 |
| 2003/0079760 | A1 * | 5/2003 | Spanyer et al. | 134/18 |
| 2003/0213371 | A1 * | 11/2003 | Saunders | 99/327 |
| 2004/0158666 | A1 * | 8/2004 | Korowitz et al. | 710/301 |
| 2005/0236389 | A1 * | 10/2005 | Goranson | 219/400 |
| 2006/0030917 | A1 * | 2/2006 | Eccleston et al. | 607/106 |
| 2006/0237052 | A1 * | 10/2006 | Picardat et al. | 134/56 D |
| 2006/0278257 | A1 | 12/2006 | Jerg et al. | |
| 2007/0024816 | A1 * | 2/2007 | Hsu et al. | 353/57 |
| 2007/0213880 | A1 * | 9/2007 | Ehlers | 700/295 |
| 2007/0295373 | A1 * | 12/2007 | Jerg et al. | 134/105 |
| 2008/0125912 | A1 * | 5/2008 | Heilman et al. | 700/275 |
| 2008/0149142 | A1 * | 6/2008 | Jerg et al. | 134/25.2 |
| 2008/0289655 | A1 * | 11/2008 | Buerkle et al. | 134/18 |
| 2009/0111065 | A1 * | 4/2009 | Tompkins et al. | 431/12 |
| 2009/0183753 | A1 * | 7/2009 | Maennle et al. | 134/18 |
| 2012/0013271 | A1 * | 1/2012 | Lei et al. | 315/308 |

FOREIGN PATENT DOCUMENTS

| | | | |
|---|---|---|---|
| EP | 0468573 | A1 | 1/1992 |
| EP | 924331 | A2 * | 6/1999 |
| EP | 1790273 | A2 | 5/2007 |
| EP | 1532306 | B1 | 5/2008 |
| RU | 2160957 | C2 | 12/2000 |
| WO | WO 9406191 | A1 * | 3/1994 |

OTHER PUBLICATIONS

Report of Examination Including national Search Report CN 200980144495.2 mailed Jan. 28, 2013.

* cited by examiner n [1/sec]
HL [W]
ΔHL
HLI
HLN
U [V]
CLn
nC
CHL
CtD
tDC
nN
UI
UN
ΔU
tD [min]
tDN
tDI
ΔTD
26,0
23,7
21,4
19,1
16,8
15,0
12,3
1400
1462
1524
1589
1654
1707
1789

HOUSEHOLD APPLIANCE HAVING AN AIR DRYING DEVICE AND/OR FLUID HEATING UNIT, AND ASSOCIATED METHOD

BACKGROUND OF THE INVENTION

The invention relates to a household appliance, in particular a household dishwasher, washing machine, clothes dryer or the like, having one or more electrical components of an air drying device and/or fluid heating device, which are connected to an electrical energy supply network (EN).

In order for example to dry items being washed in the wash compartment of a household dishwasher, said items having been sprayed with wash liquor fluids according to one or more rinse and/or cleaning processes during a run through a dishwashing program, after a final drying step, rinse aid fluid, in particular water containing rinse aid, is generally heated in the preceding final rinse step with the aid for example of a flow-through heater or a heat exchanger as the fluid heating device in the wash liquor circulation circuit of the dishwasher, to such a high temperature that the items sprayed with said heated rinse aid fluid dry automatically in the drying step that follows the end of the final rinse process due to inherent heat drying. Such inherent heat drying of the items being washed therefore requires a sufficiently large quantity of heat to be transferred to the items being washed in the final rinse step before the drying step, so that the inherent heat of the items being washed, which has built up as said items underwent the hot final rinse, is sufficient to evaporate the rinse aid fluid adhering to the items, in particular water containing rinse aid, due to the heat stored in the items being washed. The moist air thus produced is generally conducted by way of one of more condensation surfaces in the wash compartment, from which the moisture from the air condenses. This condensed water is either conducted in the wash compartment or into special collectors.

A sorption drying apparatus for drying items being washed in a dishwasher is also known from DE 10 353 577 A1. In the subprogram step "Dry" of the respective dishwashing program of the dishwasher to dry items being washed moist air from its wash compartment is conducted continuously by means of a fan through the sorption column of the sorption drying apparatus, with moisture being extracted from the air passing through due to condensation by its reversibly dehydratable sorption drying material. The air thus dried is fed back into the wash compartment of the dishwasher where it is reloaded with moisture from the water vapor in the wash compartment and fed back again to the circuit of the sorption drying apparatus. For the regeneration, i.e. desorption, of the sorption column, its reversibly dehydratable sorption drying material is heated to very high temperatures by means of an air heating unit. Water stored in this sorption drying material then exits in the form of hot water vapor and is conducted by an air flow generated by means of the fan into the wash compartment. This allows a wash liquor, an item being washed that is present in the wash compartment and/or the air present in the wash compartment to be heated during the performance of for example a rinse and/or cleaning process of a newly started dishwashing program. This allows energy-efficient cleaning and drying of items being washed.

To avoid local overheating of the drying material of the sorption column during the desorption process a heater is disposed upstream of the air inlet of the sorption column in the flow direction of the air in DE 10 2005 004 096 A1 for example.

Furthermore in some dishwashers drying devices in the form of separate heat sources, e.g. hot air fans, are used in the wash compartment to heat the moist air mixture there during the drying process so that the air in the wash compartment can absorb a larger quantity of moisture.

In addition to the field of household dishwashers such air drying devices and/or fluid heating devices are also used in household washing machines, clothes dryers, washing machines or the like.

A perfect drying performance, in particular for example for drying rinse-moist or wet items being washed in a household dishwasher, with a thermal air drying device requires a certain minimum input of heat energy into the air flow to be heated in each instance. However at the same time for reasons of energy efficiency and energy saving is it desirable for a maximum heat energy input not to be exceeded for the air drying process. The same requirements are also specified for the fluid heating device when heating a fluid, e.g. wash liquor fluid in a dishwasher or washing fluid in a washing machine.

In practice a plurality of operating parameters of the respective air drying device or fluid heating device can influence the heat energy input into an air flow or a fluid brought about in each instance. Parameter constellations can occur here, with which the functions, desired performance characteristics, in particular energy efficiency and in some instances also operating safety of the air drying system or the fluid heating system can be adversely affected.

BRIEF SUMMARY OF THE INVENTION

The object underlying the invention is to provide a household appliance with an air drying device and/or a fluid heating device, the drying performance and/or heating performance of which can be set in an improved fashion. This object is achieved with a household appliance of the type mentioned in the introduction in that at least one control/monitoring unit is provided to detect any deviation of the respective actual value of at least one characteristic of the electrical energy supply network from a target value and in that the control/monitoring unit generates at least one control signal for setting the respective electrical component based on the respectively detected deviation of the actual value.

Because at least one control/monitoring unit detects any deviation of the respective actual value of at least one characteristic of the electrical energy supply network from a target value and generates at least one control signal for setting at least one electrical component of the air drying device and/or fluid heating device connected to the electrical energy supply network based on the respectively detected deviation, it is possible to ensure its drying function and/or heating function and any further associated functions of the inventive household appliance in a perfect manner even if the actual values of the one or more characteristics of the respective electrical energy supply network change. In particular a desired heat energy input or transfer into an air flow and/or fluid can take place in a fashion that is much more easily monitored with aid of the control/monitoring unit. Fluctuations in the actual values of one or more characteristic variables of the electrical energy supply network, to which the one or more electrical components of the air drying device and/or fluid heating device are connected, can be taken into account when setting its one or more operating parameters.

In particular, in the case of a household dishwasher for example, this advantageously allows better adjustment of the one or more operating parameters of one or more electrical components of the air drying device in respect for example of drying performance, electrical energy expended, care of items being washed and other components and parts in the wash compartment of the dishwasher, etc.

The inventive control/monitoring unit can be used in particular for the air drying device and/or the fluid heating device of a household dishwasher, washing machine, clothes dryer or the like.

According to a first expedient development of the invention a characteristic of the electrical energy supply network is formed by its network voltage and/or by its network frequency. These characteristics of the electrical energy supply network are advantageously significant parameters for the air drying device and/or the fluid heating device of the inventive household appliance. They can be used in particular to determine the achievable heat energy input for the respective air drying process and/or fluid heating process, which can be brought about with the aid of the one of more electrical components of the air drying device and/or the fluid heating device.

According to a further expedient development of the invention at least one flow-though heater or heat exchanger in a fluid circulation circuit of the household appliance is provided as the electrical component of a fluid heating device to heat a fluid, in particular wash liquor fluid, washing fluid or the like.

According to a further expedient development of the invention the electrical component in the form of the air drying device features at least one heating facility and/or at least one fan unit. This allows air to be heated efficiently in a simple manner.

According to a further expedient development of the invention the air drying device is configured in particular as a sorption drying apparatus, which comprises at least one sorption container containing reversibly dehydratable sorption material. This allows more energy-efficient and improved drying of items in a wash compartment to be achieved by sorption, in particular in the case of a dishwasher. In particular sorption drying alone can be sufficient for perfect drying of moist items being washed or it can be supported by what is known as inherent heat drying. The heat energy expended for desorption of the sorption drying apparatus can advantageously be used at the same time to heat wash liquor fluid in at least one prewash and/or cleaning process of a dishwasher.

The heating facility of the sorption drying apparatus is expediently configured as an air heater for the desorption of the sorption material in the sorption container, the heating facility being provided in the air guidance channel upstream of the sorption container and/or in the sorption container upstream of its sorption unit containing the sorption material when viewed in the air flow direction. This air heater allows the sorption material to be heated for the respective desorption process in a manner that preserves said material and stored fluid, in particular water, can be driven out efficiently and reliably. The sorption drying apparatus also expediently features at least one fan unit in its air guidance channel upstream of the sorption container when viewed in the air flow direction, said fan unit being used to generate a forced air flow into at least one inlet opening of the sorption container. This forced air flow advantageously ensures an adequate throughput of air through the sorption drying material in the sorption container.

According to a further expedient development of the invention the control/monitoring unit sets the respective electrical component of the air drying device and/or the fluid heating device by means of the control signal such that the heat energy brought about in each instance by the air drying device and/or the fluid heating device is lower than an upper limit value and/or higher than a lower limit value. This largely prevents an unnecessarily high energy outlay being expended for the respective air drying process and/or fluid heating process. It also prevents an impermissibly high generation of heat occurring, for example in the sorption container of a sorption drying apparatus or in the wash compartment of a dishwasher, during the respective drying process. Limiting the heat energy produced with the aid of the control signal also ensures that any heat damage or other impermissible thermal strains, affecting for example the items being washed, the integrated components such as spray arms, racks in the wash compartment or other structural units, e.g. pump housing, pump sump, filters, etc. of a dishwasher, are avoided.

Such functional reliability is particularly advantageous if the air drying device is preferably configured as a sorption drying apparatus. Such a sorption drying apparatus comprises at least one sorption container containing reversibly dehydratable sorption drying material. For the desorption of its sorption drying material such a sorption drying apparatus features at least one air heating facility in the manner of an electrical component, which is connected to the electrical energy supply network. In order to be able to drive out water stored in the sorption material, this heating facility is used to heat the sorption material to high temperatures, in particular between 200° C. and 400° C., preferably between 250° C. and 350° C. If the network voltage of the electrical energy supply network applied to the heating facility of the sorption drying apparatus were now to become higher than the rated network voltage normally present, in the absence of protective measures the quantity of heat emitted by the heating facility could become impermissibly high, causing impairment, excessive strain or damage to the sorption material or adjacent components of the sorption container. This is now advantageously prevented, in that the control/monitoring unit detects the deviation of the overvoltage present from the rated voltage of the electrical energy supply network normally present and derives a control signal from this detected deviation, said control signal being used to limit the desorption heat energy produced by the heating facility to the extent that the upper limit value is not exceeded.

If the control/monitoring unit determines that, based on the deviation of the actual value of at least one characteristic of the electrical energy supply network from its target value, the heat energy generated by the air drying device and/or the fluid heating device would be too low, it can advantageously use the control signal in a compensating manner to ensure that at least one component of the air drying device and/or the fluid heating device is set in such a manner that the heat energy generated is greater than a lower limit value. This reliably ensures that the heat energy generated by the air drying device and/or the fluid heating device is sufficient to achieve a perfect heating result. In the case of a sorption drying apparatus is can also be ensured that its heating facility generates sufficient heat energy for the desired complete driving out of stored water during the desorption process.

According to a further expedient development of the invention the control/monitoring unit has an active connection to at least one electrical component of the air drying device and/or the fluid heating device such that the control signal counteracts any deviation of the respective actual value of at least one characteristic of the electrical energy supply network from a target value by adjusting one or more operating parameters of the one or more electrical components essentially in a compensating manner so that a desired target heat energy can largely be brought about in each instance by the one or more electrical components of the air drying device and/or the fluid heating device. This control signal of the control/monitoring unit advantageously allows changes or fluctuations in the one or more characteristics of the electrical energy supply network to be largely compensated for by corresponding setting of one or more operating parameters of one of more electrical components of the air drying device and/or the fluid heating device, in order to achieve a certain desired target heat energy by means of the air drying device and/or the fluid heating device. This ensures a constantly problem-free functional operation of the air drying device and/or the fluid heating device.

To further improve the functional reliability of the air drying device and/or the fluid heating device it can in particular be expedient if the control/monitoring unit uses the control signal to set at least one electrical component of the air drying device and/or the fluid heating device so that the heat energy brought about by the one or more electrical components at the actual values of the one or more electrical characteristics of the electrical energy supply network present in each instance largely corresponds to the target heat energy at the target values, in particular rated values, of the one or more characteristics of the electrical energy supply network. This ensures a problem-free functional operation of the air drying device and/or the fluid heating device in a particularly reliable manner.

According to a further advantageous development of the invention it can be particularly expedient for the control/monitoring unit to shorten the heating duration of the heating facility of the air drying device and/or the fluid heating device to a greater degree and/or to increase the fan speed of the fan unit of the air drying device to a greater degree, the greater the heat output brought about by the one or more electrical components of the air drying device and/or the fluid heating device based on the actual values of the one or more characteristics of the electrical energy supply network present in each instance. This allows an impermissibly high rise in the heat output of the one or more electrical components of the air drying device and/or the fluid heating device to be counteracted reliably. The shorter the heating duration selected, the lower the heat energy that can be brought about by the heating facility of the air drying device and/or the fluid heating device. The higher the fan speed selected for the fan unit of the air drying device, the faster the dissipation of heat from the quantity heat for drying purposes generated by the air drying device.

In the case of a sorption drying apparatus it is possible with these advantageous measures largely to avoid overheating, material damage or other strains on the sorption material. It is also possible to prevent unnecessary energy being wasted to achieve a desired perfect result with the respective air drying process or fluid heating process.

Conversely it can of course also be expedient for the control/monitoring unit to extend the heating duration of the heating facility of the air drying device and/or the fluid heating device to a greater degree and/or to reduce the fan speed of the fan unit of the air drying device to a greater degree, the lower the heat output brought about by the one or more electrical components of the air drying device based on the actual values of the one or more characteristics of the electrical energy supply network present in each instance. This largely ensures that a certain minimum quantity of heat energy can be generated for the respective air drying process and/or fluid heating process. In the case of a sorption drying apparatus a sufficiently high heating temperature can be achieved during the respective desorption process of the sorption material to drive out the stored water as completely as possible. The sorption material can thus be largely dried completely, in other words reversibly dehydrated, so that its original water absorption capacity is essentially restored for a new drying process. It is thus available regenerated for a new sorption drying process.

According to a further advantageous development of the invention it can in particular be expedient for the control/monitoring unit to use the control signal to set the heating facility of the air drying device and/or the fluid heating device so that its heating duration is shortened compared with the heating duration at target network voltage, if the actual electrical network voltage is greater than the target electrical network voltage, in particular the rated network voltage of the electrical energy supply network. Without this compensation measure by shortening the heating duration a voltage increase would bring about double the increase in heat output of the heating facility of the air drying device and/or the fluid heating device. Shortening the heating duration to the degree to which an increase in the network voltage produces an increase in the heat output ensures that impermissibly high temperatures in the heating facility of the air drying device and/or the fluid heating device and an unnecessarily high energy outlay are largely prevented.

According to a further advantageous development of the invention it can in particular be expedient for the control/monitoring unit to use the control signal to set the fan unit of the air drying device so that the fan speed of the fan unit is increased compared with the fan speed at target network voltage, if the actual electrical network voltage is greater than the target network voltage, particularly the rated network voltage, of the electrical energy supply network. Increasing the fan speed of the fan unit allows a larger air volume to be dissipated, resulting in a cooling effect so that it is in particular possible to ensure that the heat energy generated by the air drying device, resulting from the product of heat output and heating duration, remains within a tolerable working range.

According to a further advantageous development of the invention it can in particular be expedient for the control/monitoring unit to use the control signal to set the heating facility of the air drying device so that its heating duration is extended compared with the heating duration at target network voltage, if the actual electrical network voltage is lower than the target electrical network voltage, particularly the rated network voltage, of the electrical energy supply network. This largely ensures that a certain minimum quantity of heat energy can be generated for the respective air drying process and/or fluid heating process. It can also be expedient, additionally or independently thereof, for the control/monitoring unit to use the control signal to set the fan unit of the air drying device so that the fan speed of the fan unit is reduced compared with the fan speed at target network voltage, if the actual electrical network voltage is lower than the target network voltage, particularly the rated network voltage, of the electrical energy supply network, as the slower fan speed means that less heat is dissipated.

According to a further advantageous development of the invention it can in particular be expedient for the control/monitoring unit to comprise at least one phase leading edge control unit for adjusting the heat output of the heating facility of the air drying device and/or the fluid heating device. Alternatively or additionally hereto it can also be particularly expedient if the heating facility of the air drying device and/or the fluid heating device comprises one or more heating circuits that can be activated or deactivated individually by means of the control/monitoring unit to adjust its heat output. In some instances it can be expedient additionally or independently thereof for the control/monitoring unit to comprise at least one clock unit to time the heating facility of the air drying device and/or the fluid heating device. This allows the heat output to be set in a simple manner.

According to a further advantageous development of the invention it can in particular be expedient for the control/ monitoring unit to use the control signal to increase the heating duration and/or the heat output of the heating facility of the air drying device to a greater degree, the higher the speed of the fan unit of the air drying device brought about by the actual network frequency compared with the speed of the fan unit at the target network frequency, particularly the rated network frequency, of the electrical energy supply network. Conversely it can be expedient for the control/monitoring unit to use the control signal to reduce the heating duration and/or heat output of the heating facility of the air drying device to a greater degree, the lower the speed of the fan unit of the air drying device brought about by the actual network frequency compared with the speed of the fan unit at the target network frequency, particularly the rated network frequency, of the electrical energy supply network.

According to a further advantageous development of the invention it can in particular be expedient for the control/monitoring unit to comprise at least one main control facility and at least one additional control facility and for the additional control facility to be assigned the heating facility of the air drying device and/or the fluid heating device and/or the fan unit of the air drying device for setting purposes. This provides an additional safety reserve.

The invention further relates to a method for controlling a household appliance, in particular a household dishwasher, washing machine, clothes dryer or the like, which features one or more electrical components of an air drying device and/or fluid heating device, which are connected to an electrical energy supply network, which is characterized in that any deviation of the respective actual value of at least one characteristic of the electrical energy supply network from a target value is detected with the aid of a control/monitoring unit and the control/monitoring unit generates at least one control signal for setting the respective electrical component based on the respectively detected deviation of the actual value.

Other developments of the invention are set out in the subclaims.

BRIEF DESCRIPTION OF THE DRAWINGS

The invention and its developments along with their advantages are described in more detail below with reference to drawings, in which.

DETAILED DESCRIPTION OF EXEMPLARY EMBODIMENTS OF THE PRESENT INVENTION

Figure 1:
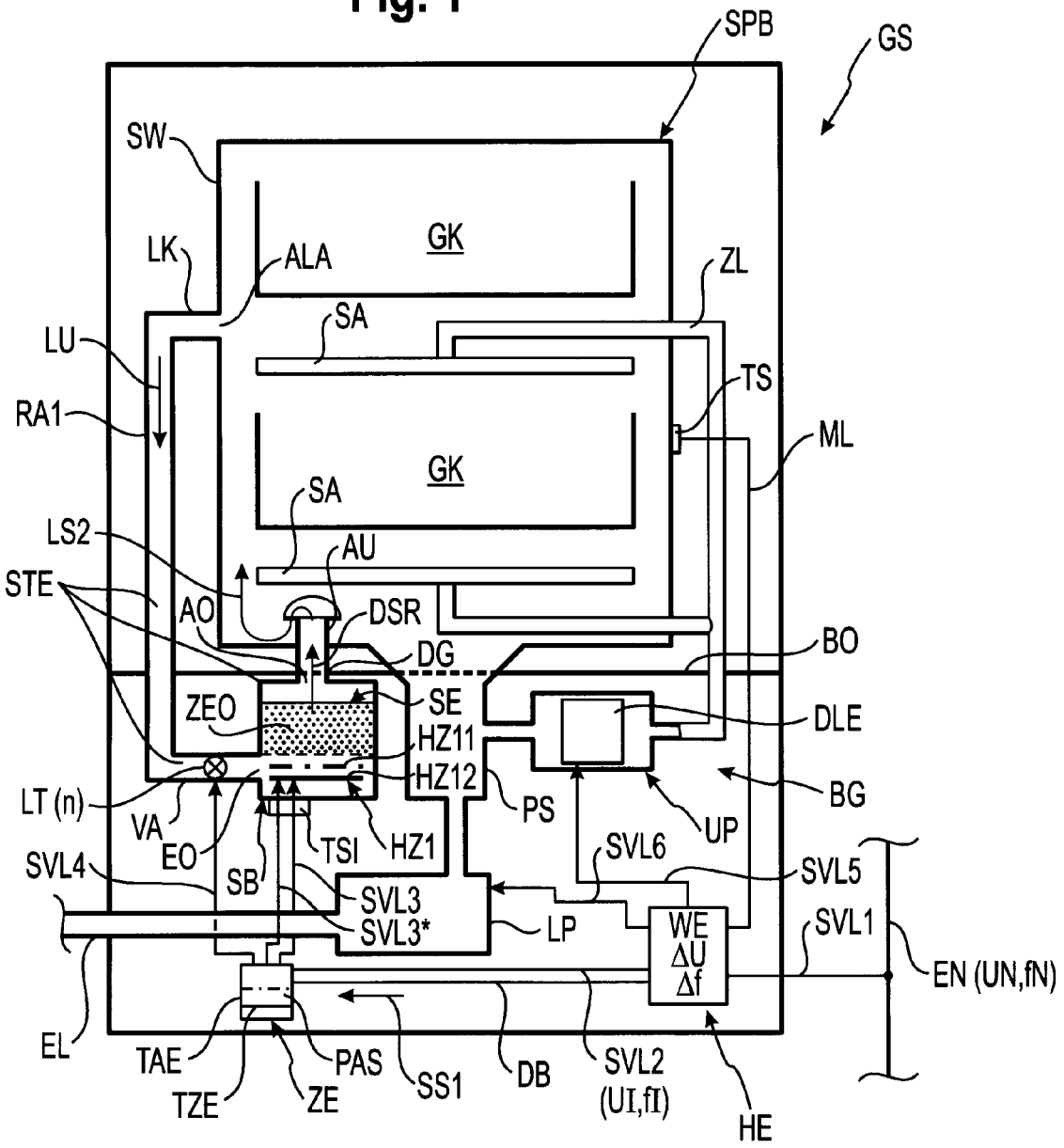
FIG. 1 shows a schematic diagram of an exemplary embodiment of a household dishwasher, which is configured according to the inventive control principle.

FIG. 1 shows a schematic diagram of a household dishwasher GS as an exemplary embodiment of an inventively configured household appliance. Its main components are a wash compartment SPB, a base module BG disposed below this and a sorption drying apparatus STE as the air drying device. The sorption drying apparatus STE is preferably provided externally, i.e. outside the wash compartment SPB, sometimes on a side wall SW and sometimes in the base module BG. As its main components it comprises at least one air guidance channel LK with at least one fan unit or blower LT inserted therein and at least one sorption container SB containing sorption drying material ZEO. One or more racks GK for holding and washing items to be washed, e.g. dishes, are preferably accommodated in the wash compartment SPB. One or more spray facilities, e.g. one or more rotating spray arms SA, are provided in the interior of the wash compartment SPB to spray the items to be washed with a fluid. In the present exemplary embodiment both a lower spray arm and an upper spray arm are suspended in a rotating manner in the wash compartment SPB.

To clean items to be washed, the dishwasher runs through wash programs, which feature a plurality of program steps. The respective wash program can in particular comprise at least the following temporally consecutive individual program steps:

at least one prewash step to remove coarse dirt by means of clean water and/or sufficiently clean used water, at least one subsequent cleaning step with detergent added to the wash liquor fluid, in particular water, at least one subsequent intermediate rinse step, at least one subsequent final rinse step with the application of fluid, in particular water, combined with surfactants, in particular rinse aid, and a final drying step, in which the cleaned items are dried.

Depending on the rinse process or cleaning step of a selected dishwashing program, fresh water and/or used water combined with detergent is applied to the items to be washed in each instance, for example for a cleaning process, for an intermediate rinse, and/or for a final rinse. In the present exemplary embodiment the fluid used in each instance is referred to as what it known as wash liquor.

In the present exemplary embodiment the fan unit LT and the sorption container SB are accommodated in the base module BG below the base BO of the wash compartment SPB. The air guidance channel LK runs from an outlet opening ALA, which is provided above the base BO of the wash compartment SPB in its side wall SW, on the outside of said side wall SW with an inlet-side pipe segment RA1 down to the fan unit LT in the base module BG. The output of the fan unit LT is connected to an inlet opening EO of the sorption container SB by way of an end connecting segment VA of the air guidance channel LK. The outlet opening ALA of the wash compartment SPB is provided at such a height above the latter's base BO that the penetration of wash liquor fluid or detergent foam is largely avoided during the respective rinse step or cleaning step.

The fan unit is preferably provided in the form of an axial fan. It serves to force a flow of moist hot air LU from the wash compartment SPB through a sorption unit SE in the sorption container SB during the respective drying process. The sorption unit SE contains reversibly dehydratable sorption material ZEO, which can absorb and store moisture from the air LU passed through it. The sorption container SB features an outflow opening AO in the region close to the top of its housing on the top face, said outflow opening AO being connected by way of an outlet element AU, in particular an outflow connector, through a push-through opening DG in the base BO of the wash compartment SPB to the interior of this latter. This allows moist hot air LU to be sucked from the interior of the wash compartment SPB through the outlet opening ALA into the air guidance channel LK by means of the activated fan unit LT during the drying step of the respective dishwashing program for drying cleaned items being washed, said moist hot air LU then being transported by way of the tubular connecting segment VA between the fan unit and the sorption container into the interior of the sorption container SB to force a flow through the reversibly dehydratable sorption material ZEO in the sorption unit SE. The sorption material ZEO of the sorption unit SE extracts fluid droplets, in particular water moisture, from the moist air flowing through so that downstream of the sorption unit SE dried air can be blown by way of the outlet element or blowout element AUS into the interior of the wash compartment SPB. This provides a closed air circulation system through said sorption drying apparatus STE.

In the sorption container SB at least one air heating facility HZ1 is disposed upstream of the sorption unit SE when viewed in the flow direction, for the desorption and therefore regeneration of the sorption material ZEO. The air heating facility HZ1 here serves to heat air LU, which is conducted by means of the fan unit LT by way of the air guidance channel LK into the sorption container SB to be blown through the sorption material ZEO of the sorption unit SE there. In the process this forced-heated air LS2 absorbs stored moisture, particularly water, from the sorption material ZEO as it flows through said sorption material ZEO, such moisture having been stored therein previously in a previous drying step of a completed dishwashing program. This water that has been driven out of the sorption material ZEO is transported by the heated air by way of the outlet element AUS of the sorption container SB into the wash compartment SB. This desorption process preferably takes place when the wash liquor fluid has to be warmed or heated at the start of a wash process, in particular a prewash process, and/or subsequent cleaning process of a subsequent dishwashing program. The air heated by the air heating facility HZ1 for the desorption process can then advantageously be used at the same time as it heats the wash liquor fluid in the wash compartment SPB to heat the latter's interior walls and/or the items being washed in the wash compartment, which saves energy.

The dishwasher GS also features a pump sump PS in the base BO of its wash compartment SPB, said pump sump PS having a filter system. The pump sump PS serves to collect wash liquor which is sprayed from the spray arms SA during the respective wash process. The pump sump PS is connected by way of a line system ZL to the upper and lower spray arms SA. A circulation pump is provided in the connection region of the pump sump PS to feed the wash liquor fluid out of the pump sump PS into the supply lines of the line system ZL. A suction or drain pump LP is also connected to the pump sump PS to pump some or all of the used wash liquor fluid out of the pump sump PS into a waste water line EL.

To heat the wash liquor a flow-through heater DLE or a heat exchanger is provided as the fluid heating apparatus in the line system ZL, in the present exemplary embodiment in the circulation pump UP. It is supplied with electrical energy by way of at least one energy supply line SVL5 from a main control facility HE. In particular the electrical energy supply line SVL5 comprises at least a first power supply line in the form of a voltage-carrying phase and at least second power supply line in the form of a neutral conductor. The main control facility HE is connected by way of a connecting energy supply line SVL1 to the public energy supply network EN. It switches the energy supply line SVL5 through to the flow-through heater DLE when the wash liquor has to be warmed or heated for the respective wash process or cleaning process and deactivates it when the wash liquor does not have to be heated.

In FIG. 1 an additional control facility ZE is provided in the base module BG in addition to the main control facility HE, serving to control and monitor as well as supply energy to the fan unit LT and the air heating facility HZ1 of the sorption drying apparatus STE. To this end the additional control facility ZE is connected by way of an energy supply line SVL2 to the main control facility HE. The additional control facility ZE is also activated from the main control facility HE by way of a bus line or signal line DB. At least one energy supply line SVL3, SVL3* is passed from the additional control facility ZE to the heating facility HZ1 of the sorption container. It comprises in particular a first power supply line in the form of a voltage-carrying phase and a second power supply conductor in the form of a neutral conductor. The additional control facility ZE also activates the fan unit LT by way of a control line SLV4. A power supply line for the fan unit LT in particular can also be integrated in the control line SLV4.

As soon as a drying process using the sorption drying apparatus STE is required at the end of a dishwashing program, the main control facility HE conveys a control signal SS1 by way of the control line DB to the additional control facility ZE prompting this latter to activate the fan unit LT by way of the control line SL4 so that moist hot air can be sucked out of the wash compartment into the air guidance channel LK and be fed to the sorption container SB for drying.

Once a desorption process has been initiated by the main control facility HE, this latter conveys to the additional control facility ZE by means of the control signal SS1 that the heating facility HZ1 of the sorption container SB and the fan unit LT are activated.

In order now to be able to operate the various electrical components, e.g. the flow-through heater DLE, the air heating facility HZ1 of the sorption container SB, the fan unit LT in the air guidance channel LK of the sorption drying apparatus STE, without any problems and in a functionally reliable manner within a predefined working range, their operating variables, e.g. heat output, heating duration, etc. . . . for the flow-through heater DLE and the air heating facility HZ1 or speed n for the fan unit LT, are set in respect of predefined target values for one or more characteristics of the electrical energy supply network EN. A specific target value for the respective characteristic of the electrical energy supply network is therefore used as the reference or initial basis for setting parameters or operating parameters of the respective electrical component. In particular the target value of the respective characteristic of the electrical energy supply network can be formed by its rated value. Significant characteristics of the electrical energy supply network are in particular its network voltage U and its network frequency f. The respective setting range of a parameter of the respective electrical component which allows problem-free operation for this, is defined here in the present exemplary embodiment in relation to the rated values UN, fN of the network voltage U and the network frequency f of the electrical energy supply network EN. As long as the electrical energy supply network EN supplies these rated values UN, fN for the network voltage U and the network frequency f, it is possible to ensure problem-free operation of the respective electrical component HZ1, LT, DLE.

The operating parameters, such as heating duration td, heat output HL, fan speed n, of the one or more electrical components, e.g. LT, HZ1 of the air drying device, e.g. STE and/or fluid heating device, e.g. DLE, are expediently coordinated in a standard manner in relation to the rated values of the characteristics, e.g. the rated voltage and rated frequency of the respective electrical energy supply network, so that a certain desired heat energy input can be introduced into the wash compartment for the respective drying process or into the sorption container for the respective desorption process. With this basic assignment the respectively desired target heat energy input is therefore calculated based on the normal rated values of one or more characteristics of the respective electrical energy supply network. This assignment between the rated values of the one or more characteristics of the electrical energy supply network and the parameter settings of the one of more electrical components of the respective air drying device and/or fluid heating device therefore determines a desired target heat energy input for the respective drying process or desorption process. In practice however, if the characteristics of the electrical energy supply network deviate from these rated values, it can happen that the heat energy input brought about by the air drying device and/or the fluid heating device deviates to an impermissibly large degree from the calculated heat energy input. In the case of a drying process this can result for example in an undesirable drying temperature or in the case of a desorption process for example in an unsatisfactory desorption result. In the case of the desorption process it could result, for example with too high a heat output, particularly in impermissible thermal strains or damage to the sorption material.

In order to provide an air drying device, in particular a sorption drying apparatus, and/or a fluid heating device, in particular a flow-through heater, for the household dishwasher, the one or more electrical components of which can be set more precisely than previously, in other words in a controllable manner, to achieve a certain heat energy input in each instance, the following advantageous control method in particular is implemented in general terms:

If the respective actual value of at least one characteristic, e.g. the network voltage U or the network frequency f of the electrical energy supply network EN, deviates from its target value, e.g. the rated network voltage UN or the rated network frequency fN, the control/monitoring unit in the form of the main control facility HE detects or determines this deviation and derives a control signal SS1 therefrom to set the respective electrical component, for example for the heating apparatus HZ1 and/or the fan unit LT of the sorption drying apparatus STE and/or for the flow-through heater DLR. If the electrical energy supply network EN for example supplies a higher actual voltage value UI than the rated voltage value UN, the control/monitoring unit HE detects this voltage deviation ΔU and derives therefrom a control signal SS1 to adjust the respective electrical component. The main control facility HE correspondingly detects any undervoltage present in the electrical energy supply network EN compared with its rated voltage value and generates a control signal therefrom to adjust the respective setting parameter of the respective electrical component. Additionally to or independently of a voltage deviation a frequency deviation Δf of the current actual value fI of the network frequency f compared with its rated value fN can similarly be detected by the main control facility HE and a control signal can be derived therefrom to correct the respective setting parameter or operating parameter of the respective electrical component. The control signal for correcting the respectively detected deviation is formed by the control/monitoring unit HE so that the respective setting parameter of the respective electrical component is changed in such a manner that said component can be operated in a problem-free manner within its predefined working range.

In respect of the sorption drying apparatus STE the following control of the heating facility HZ1 and the fan unit LT is performed with the aid of the main control facility HE and with the additional control facility ZE actively connected by way of the databus line DB, in particular for its respective desorption process:

The main control facility HE monitors whether a voltage deviation ΔU of the actual value UI of the network voltage U from the rated voltage value UN and/or a frequency deviation Δf of the actual value fI of the network frequency f from the rated value fN is present. This check can be performed in particular continuously or at periodic time intervals. In particular this inquiry or check can be performed immediately before the start or at the start of the respective desorption process. If the main control facility HE registers a network overvoltage, i.e. determines that the current network voltage value UI is greater than the rated network voltage value UN, it derives a control signal SS1 from this voltage deviation such that the heating duration td and/or the heat output HL of the heating facility HZ1 is reduced so that the heating facility HZ1 in the sorption container SB brings about a heat energy input that corresponds essentially to the heat energy input of the heating facility HZ1 at rated voltage UN.

In the European power supply network for example voltage fluctuations ΔU between 196 volts and 254 volts can occur at a nominal voltage UN of 230 volts and frequency fluctuations Δf between 16 and 60 Hz can occur at a nominal network frequency fN of 50 Hz. The voltage fluctuations ΔU impact directly on the heat output HL of the heating facility HZ1 of the sorption drying apparatus STE, e.g. during a desorption process, since the voltage change ΔU features quadratically in the electrical heat output HL of the heating facility HZ1. Temperatures can therefore result in the heating facility HZ1 and by association in the sorption material ZEO, which are outside the tolerable working range for the heating facility HZ1 and/or of the sorption material ZEO. If for example the voltage U rises to an overvoltage UI of 254 volts, which corresponds to a percentage rise ΔU of around 9.5% compared with the nominal voltage UN of 230 volts, the heat output of the heating facility increases by around 18%. This is illustrated in the diagram in FIG. 2. The network voltage U in volts (V) is shown along the abscissa here. The heating duration tD of the heating facility HZ1 in minutes (min) is shown along the left ordinate while the heat output HL of the heating facility HZ1 in watts (W) and the speed n of the fan unit LT in 1/sec are assigned to the right ordinate. The curve CHL shows the rise in the heat output HL of the heating facility HZ1 as a function of increasing voltage values of the network voltage U. At rated voltage UN=230 volts the heating facility HZ1 delivers a heat output HLN of around 1400 watts. If the network voltage U rises to an actual value UI of 254 volts, in the present exemplary embodiment the heating facility HZ1 emits a heat output of around 1707 watts (W). While the voltage U has risen from the rated voltage UN=230 volts to the actual voltage UE=254 volts by around 9.5%, the heat output increases by roughly double that to HLI=1701 watts compared with the heat output HLN=1400 watts at rated voltage UN. This corresponds to a rise of around 20%. The heat output therefore rises in percentage terms by around double the respective percentage voltage rise. To compensate for or equalize this heat output rise ΔHL, the main control facility HE generates a control signal SS1, which reduces the heating duration tD of the heating facility HZ1 at least to the degree by which the heat output HL increases. In particular it reduces the heating duration tD at least roughly in proportion to the heat output increase ΔHL. This reduction of the heating duration tD produces the linearly falling curve CtD in FIG. 2. If at rated voltage UN=230 volts the heating facility HZ1 is operated in an activated manner for a heating duration tDN of roughly 26 minutes at a heat output HLN of roughly 1400 watts for the respective desorption process, in the present exemplary embodiment the heating duration tD at the overvoltage UI=254 volts and the associated resulting heat output HLI=1707 watts is reduced to a corrective value tDC of around 15 minutes. Compared with the heating duration tDN=26 minutes at the rated voltage UN this is a reduction of roughly 57% of the heating duration tD. This is more than would be actually be necessary to compensate for the increase ΔHL in heating output. For the 20% heat output increase ΔHL a roughly 20% reduction ΔtD of the heating duration tD to around 20 minutes heating time is sufficient to achieve the same heat energy input WE=WEN as at rated value UN.

Figure 2:
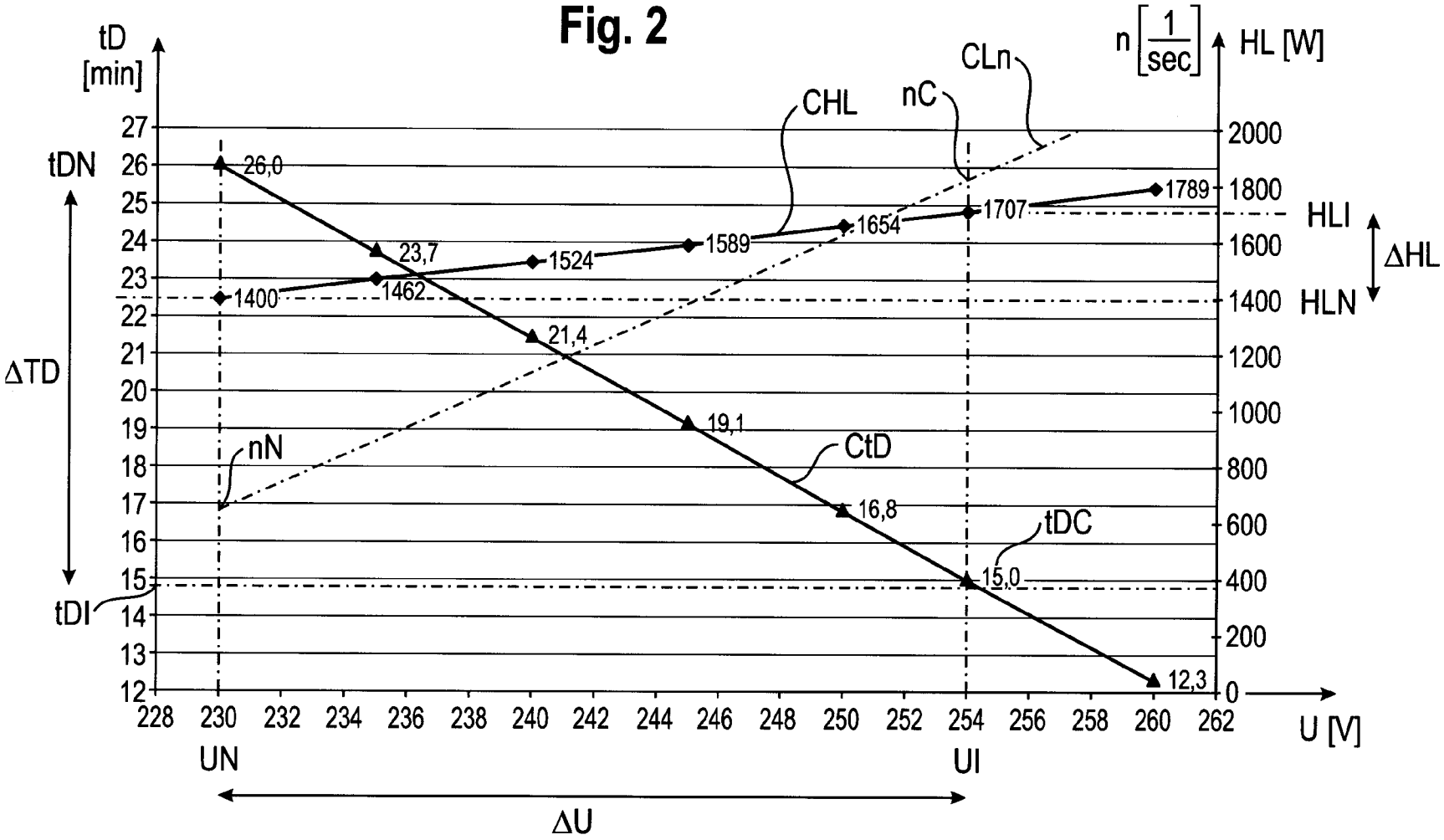
FIG. 2 shows a schematic illustration of a diagram with compensation curves for the heating duration and fan speed of the air drying device of the household dishwasher from FIG. 1 as a function of the network voltage of an electrical energy supply network.

In order therefore to be able to compensate largely for a voltage increase ΔU and an associated roughly double heat output change ΔHL, the respective control/monitoring unit, in this instance the main control facility HE with the aid of the additional control unit ZE, generates a control signal such that the heating duration tD is reduced in essentially inverse proportion to the heat output increase ΔHL. It can in particular be expedient to reduce the heating duration tD by a compensation factor, which is great than the heat output increase factor. This provides a safety reserve, to reliably prevent impermissible overheating occurring during desorption. In general terms it can therefore be expedient to reduce the heating duration tD more than the heat output HL increases in the event of a voltage increase. This is illustrated in FIG. 2 in that the correction line CtD drops more steeply for the heating duration tD than the straight line curve CHL rises for the heat output HL.

To summarize, because for any voltage increase of the network voltage the heating duration is reduced at least by a compensation factor which corresponds to the increase in heat output of the heating facility based on the voltage increase, it is possible to prevent overheating of the sorption material in the sorption container in a reliable manner. This compensation also allows the temperature of the air flowing through the sorption container (see LS2 in FIG. 1) during the respective desorption process to be kept in a tolerance range in which impermissible thermal strains or even damage to the interior of the wash compartment, integral parts such as racks, spray arms, etc. in the wash compartment, and items being washed are largely avoided. Since these compensation measures mean that the sorption container can always be kept in a non-critical temperature range during the respective desorption process, the temperatures in the area around the sorption container remain so low that the base module with its components, such as plastic parts, pumps, motors, insulation, etc., are protected from impermissibly high thermal strains and even destruction. It is however primarily advantageous that during the respective desorption it is always ensured that the sorption material is treated in a preserving fashion, in other words excessive thermal strains on the sorption drying material are largely prevented.

Conversely, if an undervoltage occurs, i.e. the network voltage U is lower than its rated voltage UN, the main control facility HE with the aid of the additional control facility ZE increases the heating duration tD to essentially the same degree, i.e. in direct proportion to the reduction of the heat output reduction ΔL associated with the voltage reduction, in order to be able to introduce into the sorption container containing the sorption material by means of the heating facility such sufficient heat energy as is required for perfect desorption of the sorption material.

Additionally or independently of the reduction of the heating duration tD it may also be advantageous to use the control signal of the control/monitoring unit HE to instruct the additional electronic control system ZE to increase the speed n of the fan unit LT, in order to be able to compensate for a voltage rise ΔU and an associated increase in the heat output HL. The rising straight line curve CLn in FIG. 2 illustrates this. If at the rated voltage UN the fan speed n is set to the rated value nN, the control signal SS1 of the main control facility HE raises this to a correction speed nC that is higher than said rated speed nN. This increases the throughput of air through the sorption container SB, so that the period for which the air remains in the sorption container SB is shorter compared with conditions at rated voltage UN and the air is therefore heated less. The higher flow speed for the air flow through the sorption container SB associated with a higher fan speed of the fan unit brings about cooling for the sorption drying material. The increase in the fan speed can take place here in support of the reduction of the heating duration tD or as a separate corrective measure.

In contrast if the electrical energy supply network EN shows an undervoltage, i.e. the network voltage U drops to a lower value UI than its rated voltage UN, it may be expedient for the control/monitoring unit HE to reduce the speed n of the fan unit LT. This reduces the throughput of air through the sorption container SB so that the period for which the air remains in the sorption container is longer compared with conditions at rated voltage UN and the air can therefore be heated more effectively. This ensures that a sufficiently hot air flow can flow through the sorption material during the respective desorption process, in order to be able to drive out the water stored there as completely as possible, so that the sorption material can be made available having been reprocessed for a new drying process.

Reduction of the fan speed n can be initiated here as a compensatory measure by the control/monitoring unit in addition to or independently of increasing the heating duration. It is particularly expedient for the fan speed settings to use what is known as a BLDC or brushless direct current motor for the fan unit.

Figure 3:
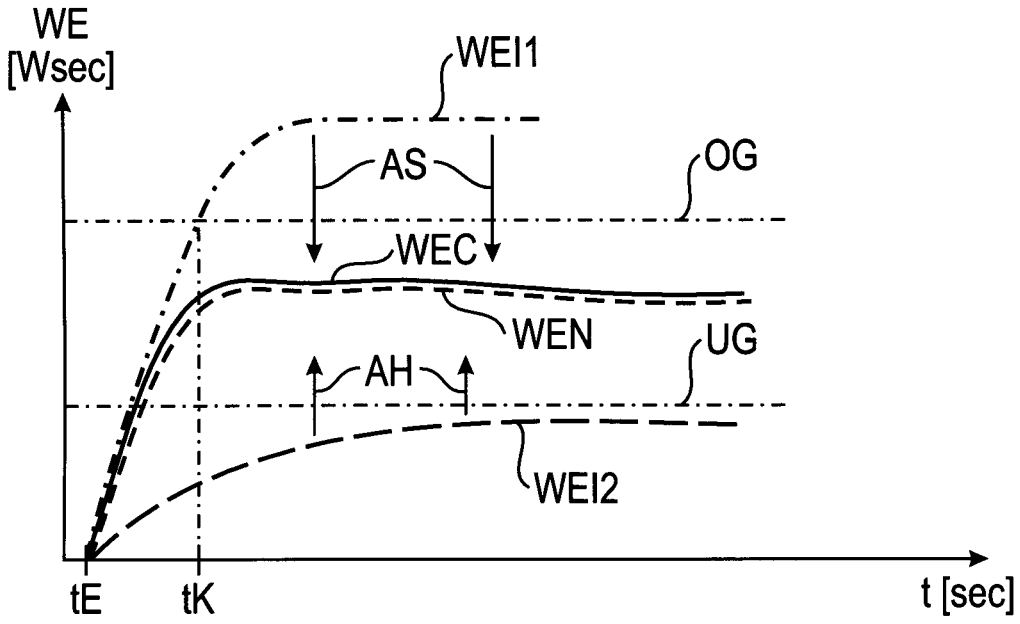
FIG. 3 shows a schematic illustration of a heat energy diagram, showing the compensation control of the household dishwasher from FIG. 1 to comply with a desired working range, and elements of identical function and mode of operation are shown respectively with the same reference characters in FIGS. 1 to 4.

By reducing the heating duration tD and/or increasing the fan speed when a network overvoltage is present, the heat output rise of the heating facility brought about by the network voltage increase can be reduced to such a degree that the heat energy input of the heating facility in the sorption container can be adjusted to below a permissible upper limit. This is illustrated in FIG. 3. The duration t is shown along the abscissa here, while the heat energy input WE in watts per second is assigned to the ordinate. In order to be able to desorb the sorption drying material ZEO in the sorption container SB sufficiently, the heat energy input by the heating facility into the air flowing through the sorption material has to be above a critical lower limit OG. This is shown in FIG. 3 as a horizontal dot/dash line. Only when the heat energy input WE into the sorption material ZEO is above this critical lower limit OG can a sufficient quantity of water be driven out of the sorption material during the respective desorption process, in other words the sorption material can be dried sufficiently so that it is available largely regenerated for a subsequent drying process for wet items being washed. It is also necessary for the heat energy input WE to remain below a critical upper limit OG during the respective desorption of the sorption material ZEO to prevent the sorption drying material being subjected to impermissible thermal strains, damaged or even destroyed. The upper limit OG is also shown as a horizontal dot/dash line in FIG. 3. Only if the heat energy input WE remains below this upper limit OG during the respective desorption process can it be largely ensured that the original material characteristics of the sorption material ZEO are largely maintained over the entire operating life of the dishwasher and sufficient sorption efficiency and desorption efficiency can be ensured for the sorption drying material on a sustainable basis. Therefore if the heat energy input WE brought about in the sorption container by the heating facility HZ1 remains within the bandwidth or range between the lower limit UG and the upper limit OG during the respective desorption process, it can largely be ensured that on the one hand the sorption material can be sufficiently desorbed and on the other hand the sorption material still has sufficient sorption capacity for the drying process following the respective desorption process. Material aging due to impermissibly high thermal strains on the sorption material is therefore largely prevented, if the heat energy input WE remains below the upper limit OG. If the overvoltage UE is so high compared to the rated voltage UN that after the start point tE of the desorption process the heat energy input WE brought about by the heating facility HZ1 in the sorption container SB exceeds the upper limit OG at the subsequent time point tK, from this critical time point TK the heat energy input WE is above the permissible upper limit OG. This is shown by the curve WEI1 in FIG. 3. It rises from the start point tE of desorption and is above the permissible upper limit OG from the critical time point tK. To prevent this impermissibly high heat energy input WEI1, which would occur due to the excessive overvoltage without corrective measures, the control/monitoring unit, in this instance the main control facility HE, determines a correction factor for at least one setting parameter of the heating facility HZ1 and/or its assigned fan unit LT so that the actual heat energy input WE brought about is below the upper limit OG. This correction factor is transmitted by the main control facility HE to the additional control facility ZE by means of the control signal SS1. In the present exemplary embodiment said additional control facility ZE brings about a reduction of the heating duration tD and/or an increase in the fan speed n so that the heat energy input WEI1, which would be introduced by the heating facility HZ1 into the sorption container SB without a corrective measure, is now lowered to below the upper limit OG with a corrective measure. The profile of the heat energy input thus corrected and lowered is shown as WEC in FIG. 3. It can in particular be expedient to shorten the heating duration tD and/or increase the fan speed n so that the lowered, corrected heat energy input profile WEC corresponds essentially to the profile of the heat input WEN at rated voltage UN. This is shown with a dot/dash line in FIG. 3. The lowering of the heat energy input brought about is shown by arrows AS.

Conversely if the control/monitoring unit HE determines that an impermissibly large undervoltage of the electrical energy supply network EN is present, i.e. its actual voltage is too far below the rated voltage UN, the respective control/monitoring unit uses at least one control signal to initiate the changing of at least one setting parameter of the heating facility HZ1 and/or the fan unit LT so that the heat energy input brought about by the heating facility HZ1 in the sorption container SB comes to lie above the critical lower limit UG. This is illustrated in FIG. 2, where the profile of the too low heat energy input at too low a network voltage is shown by the broken curve WEI2. This heat energy input WEI2 would not be sufficient to bring about adequate drying of the sorption material during the respective desorption process. The main control facility HE now prompts the additional control facility ZE by means of the control signal SS1 to increase the heating duration tD and/or reduce the fan speed n of the fan unit to such a degree that at this given undervoltage the heat energy input is increased to such a degree that it is above the critical lower limit UG and below the critical upper limit OG. This increasing of the heat energy input is shown by arrows AH in FIG. 3.

It can in particular be expedient to increase the heat energy input WEI2 by increasing the heating duration tD and/or reducing the fan speed n to such a degree that it can be adjusted into the range of the reference heat input WEN at rated voltage UN.

To ensure that the heat energy input WE is always within the permissible range between the lower limit UG and the upper limit OG, a control signal is used to adjust the heat output HL of the heating facility HZ1 and/or the fan speed N of the fan unit LT, when an impermissibly high overvoltage or impermissibly large undervoltage is present, which would result in the upper limit OG or lower limit UG being crossed. The heat output HL can in particular be influenced here by corresponding setting of the heating duration tD.

It can also be expedient in some instances for the heat output HL of the heating facility HZ1 to be adjusted by providing a phase leading edge control unit. In the present exemplary embodiment in FIG. 1 a phase control facility PAS is provided in the additional control facility ZE. It is shown simply with a dot/dash line in FIG. 1.

In some instances it may also be advantageous, in addition to or independently of the other measures for setting the heat output, to time the heating facility HZ1. A clock unit is expediently provided for this purpose. In the exemplary embodiment in FIG. 1 the additional control facility ZE comprises such a clock unit TAE to time the heating facility HZ1. The clock unit TAE can be used to activate and deactivate the heating facility HZ1 at periodic or in more general terms at predefinable time intervals. Since heating phases alternate with dead phases, i.e. deactivation phases of the heating facility HZ1, the sorption material ZEO in the sorption container SB can advantageously be subjected in a more measured manner to a certain desired heat output than would be possible without timing with an interrupted, continuous emission of the heat output of the heating facility HZ1.

It may also be advantageous, in addition to or independently hereof, for the specific influencing of the heat output of the heating facility HZ1, to provide a number of heating circuits for the heating facility HZ1, which can be switched on or off. In the present exemplary embodiment in FIG. 1 the heating facility HZ1 has a second heating circuit HZ12, shown with a dot/dash line, in addition to the first heating circuit HZ11. The activation or deactivation of the two heating circuits HZ11, HZ12 is performed here from the additional control facility ZE in that the respective energy supply line in the first heating circuit HZ11 or to the second heating circuit HZ12 is connected to the energy supply network EN or interrupted. Instructions to this effect are output from the main control facility HE and are transmitted by means of the control signal SS1.

If the control/monitoring unit determines that the network frequency f deviates from the target network frequency fN of the energy supply network EN, according to a further expedient correction variant it can initiate corresponding measures to adjust at least one setting parameter of at least one electronic component of the sorption drying apparatus STE, to ensure that the heat energy input WE actually introduced into the sorption container SB comes to lie within the permissible working range between the lower limit UG and the upper limit OG. A change in the network frequency fI compared with the rated frequency fN can result in a change in the speed n of the fan unit LT for example. This is particularly the case, if a split pole motor or another alternating frequency electric motor is used for the fan unit LT. Changing the speed n of the fan unit LT means that the air volume flow or air mass flow conveyed by the fan unit LT is changed compared with conditions when the rated network frequency is present. In other words the sorption container SB is subjected to a changed air throughput compared with conditions when the rated network frequency fN is present. If the actual frequency fI is greater than the rated frequency fN, the speed n of the fan unit LT increases, with the result that the heating temperature in the sorption container SB would drop assuming the heating facility was emitting the same heat output as at rated frequency, as the air throughput is now increased, since the flow speed of the air flowing through the sorption container SB is greater than before at rated frequency fN. As a result the air flowing through cannot be heated as intensely by the heating facility HZ1 as at rated frequency fN. This would also be associated with a smaller heat energy input WE into the sorption material ZEO. In order to be able to ensure that the heat energy input WE into the sorption material ZEO is within the desired working range between the lower limit UG and the upper limit OG, it is possible to counteract the drop in the lower air temperature at a higher speed either by increasing the heating duration during the respective desorption process, increasing the heat output of the heating facility by connecting at least one further heating circuit to the first heating circuit and/or increasing the heat output of the heating facility HZ1 by means of a phase leading edge controller.

Conversely, if the actual frequency fI is lower than the rated frequency fN, which would result in a lower speed n of the fan unit LT and therefore an increasing air heating temperature, it is possible to counteract the associated higher heat energy input by changing the following operating parameters of the drying apparatus STE in particular:

the heating duration tD is reduced compared with the heating duration tDN at rated frequency fN during the respective desorption process, the heat output of the heating facility HZ1 is reduced by deactivating one or more of its heating circuits, and/or the heat output of the heating facility is reduced by a phase leading edge controller compared with the heat output at rated frequency fN.

In the same manner as for the sorption drying apparatus STE it can also be ensured by means of the control/monitoring unit for at least one further electrical component of the dishwasher GS that said electrical component operates within its permissible operating range when there are deviations of the actual value of at least one characteristic of the electrical energy supply network compared with its target value. To this end the control/monitoring unit generates at least one control signal to set at least one operating parameter of said electrical component. In this process it sets the respective operating parameter of said electrical component in particular so that the displacement of the working range produced by the change in the actual value of the respective characteristic is largely counteracted. This means that a desired working range for the respective electrical component can always be maintained, i.e. even if because of fluctuations in characteristics the electrical energy supply network always has characteristic values that deviate from the rated values of these characteristics. In the present exemplary embodiment in FIG. 1 the control/monitoring unit can for example also set the flow-through heater DLE as a fluid heating apparatus so that it always emits the heat energy required for a certain wash process to the wash liquor, even in the event of fluctuations in the electrical characteristics of the energy supply network. To this end the control/heating facility sets at least one operating parameter, such as the heating duration of the flow-through heater DLE for example, based on the detected deviation of the respective electrical characteristic from its target value, so that this changed manipulated variable is counteracted or its effect is largely compensated for. This allows any change in the heat energy input of the flow-through heater DLE due to changed characteristic values of one or more network characteristics to be largely compensated for, so that essentially the same conditions can prevail as with the presence of the reference value, in particular the rated value, of this one or these several characteristics.

It should also be pointed out that of course the fan unit LT can also be corrected in respect of its speed according to the principles outlined in detail above during the respective sorption process of the sorption drying apparatus STE, during which the heating facility HZ1 is generally deactivated, if fluctuations occur in one of more network characteristics.

It may in some instances also be sufficient for the respective drying process if only the sorption drying apparatus is operated. In some instances it may also be expedient to use the flow-through heater for additional inherent heat drying by heating wash liquor fluid in a rinse process that precedes the drying process in time. It is then possible to control or set both the sorption drying apparatus and the flow-through heater or heat exchanger according to the principles set out above. If the flow-through heater or heat exchanger alone is used for the respective drying process, the above control methods can be used correspondingly for it.

It may be expedient in some instances to omit the additional control facility SE and integrate its control function for the fan unit LT and the heating facility HZ1 in the main control facility HE.

To summarize, at least one control logic is used advantageously to ensure that influencing factors for fluctuations in the one or more characteristics of the electrical energy supply network, in particular also for sorption parameters and/or desorption parameters of a sorption drying apparatus of a dishwasher, can largely be taken into account. In the European power supply network for example voltage fluctuations between 196 volts and 254 volts can occur at a nominal voltage of 230 volts and frequency fluctuations between 16 and 60 Hz can occur at a nominal network frequency of 50 Hz. The voltage fluctuations impact directly on the heat output of the heating facility of the sorption drying apparatus for the respective desorption process, as the voltage essentially features quadratically in the electrical heat output of the heating facility of the sorption drying apparatus. Temperatures can therefore result in the heating facility and by association also in the sorption container and its sorption material, which are outside the tolerable range for the heating facility, the sorption container and its sorption material. In particular the functionality of the sorption material can be damaged or it can be totally destroyed by excessive thermal strains or overheating. Also in the case of alternating voltage motors, e.g. split pole motors, used for the fan unit, frequency fluctuations in the network voltage can impact on their speed and therefore on the air volume flow conveyed, which would in turn affect the temperatures in the sorption container SB. If for example the voltage rises to an overvoltage of 254 volts, which corresponds to a percentage rise of around 9.5% compared with the nominal voltage of 230 volts, the heat output of the heating facility would increase by around 18%-20% without a counter measure, as the heat output increases quadratically with the voltage rise. As a result the heat generated by the heating facility in the sorption container increases, which would cause the temperatures in the sorption container to rise, possibly resulting in it being damaged or subjected to excessive strain. Similarly without a corrective measure the temperature of the air flow blown out into the wash compartment would rise during the respective desorption process, possibly causing damage to parts in the interior, e.g. dishes, racks, spray arms, etc. There could also be an impermissible temperature rise in the area around the sorption container, so that the base support of the base module, surrounding plastic parts and components of the base module, e.g. pumps, motors and the insulation of the base module on the underside of the base up to the wash compartment, etc. could be subjected to excessive thermal strains, damaged or destroyed.

At an undervoltage of 196 volts for example, the necessary temperatures required for perfect desorption of the sorption material of around 240° C. would not be reached, which would impact in a negative manner on the water absorption capacity of the sorption material during the next drying process with the result that the drying performance in the next drying process would be negatively influenced.

In order to be able to compensate largely for such fluctuations in the network voltages and/or the network frequency, the control logic can be used to set one or more parameters of one or more electrical components of the sorption drying apparatus to counteract such fluctuations. It is thus possible for example to extend the heating duration when an undervoltage is present. Conversely it is possible to short the heating duration for the heating facility when an overvoltage is present. In the even of an overvoltage a phase leading edge controller can correspondingly be used to reduce the heat output of the heating facility if an overvoltage occurs. In addition to or independently of this the heat output can be varied by using at least two heating circuits. Thus for example in the event of an overvoltage just one heating circuit can be activated, while in the event of an undervoltage two heating circuits can be activated. In addition to or independently of these measures the fan speed of the fan unit can be increased in the event of overvoltage to achieve a higher air volume throughput and to allow the hot air to flow quickly enough through the sorption material of the sorption container. Conversely the fan speed can be correspondingly reduced in the presence of an undervoltage.

It may in particular be expedient both to reduce the heating duration and to increase the fan speed, if an overvoltage compared with the nominal voltage occurs. Conversely it may be expedient to increase the heating duration and reduce the fan speed, if an undervoltage compared with the nominal voltage occurs.

If the control logic determines a change in the network frequency compared with the nominal frequency of the supplied network voltage, it can regulate the effects of the network frequency fluctuations in a compensatory fashion in the same manner as for fluctuations in the network voltage by adjusting the heating duration, the heat output, e.g. by means of at least two activatable and deactivatable heating circuits or timing and/or the heat output by phase control of the heating facility. This ensures an adequate performance or adequate desorption efficiency even in the event of changing conditions in the energy supply system, e.g. voltage fluctuations and/or frequency fluctuations. This means corresponding sorption efficiency during the next drying process. It is also possible to ensure the thermal safety of the wash compartment and the area around the sorption container all the time in such changing operating conditions, as the control logic can always set a safe operating range for the sorption drying apparatus. Intervention of the control logic in respect of one or more operating setting parameters of the electrical components of the sorption drying apparatus, in particular the fan unit and/or the heating facility in respect of changed actual values of the one or more characteristics of the electrical energy supply network compared with their rated values means that perfect regeneration of the sorption material can be brought about during every desorption process. This also produces perfect drying results during the following desorption process in each instance. The thermal safety of the wash compartment, the components therein and the area around the sorption container can also be guaranteed. Finally it can be ensured that the sorption material, in particular the zeolite, in the sorption container can be heated with extreme care during the respective desorption process to drive out the water stored there. It can in particular be largely ensured that even if the values of one or more of the characteristics of the electrical energy supply network change, the heating temperature profile in the sorption material is one that largely preserves the material during the respective desorption process.

These advantageous control variants described above can also advantageously be used for at least one air drying device and/or at least one fluid heating device of at least one other household appliance, e.g. a washing machine, clothes dryer, or the like.

To summarize, in general terms therefore in an inventively configured household appliance at least one control signal is derived from any deviation occurring of the respective actual value from the target value of at least one characteristic of the electrical energy supply network. This control signal can be used to set the one or more electrical components of the air drying device and/or fluid heating device of the inventive household appliance adaptively as a function of changes in the actual values of one or more characteristics of the electrical energy supply network to achieve a certain desired heat energy input for the respective air drying device and/or fluid heating device. In other words fluctuations or changes in the respective actual value compared with the target value of the respective characteristic of the electrical energy supply network can be taken into account when setting one or more operating parameters of the respective electrical component of the air drying device and/or fluid heating device.

The invention claimed is:

1. A household appliance, comprising at least one member selected from the group consisting of an air drying device and a fluid heating device, said member being configured to draw electrical power from an electrical energy supply network; and at least one controller configured to detect any deviation of an actual value of at least one characteristic of the electrical energy supply network from a target value and to generate at least one control signal for setting an electrical component of the member in response to a detected deviation of the actual value, wherein the controller is configured to provide the at least one control signal to the electrical component of the member such that any deviation of the actual value of the at least one characteristic of the electrical energy supply network from a target value is counteracted by adjusting an operating parameter of the electrical component essentially in a compensating manner to substantially maintain a desired target heat energy by the electrical component of the member while operating the electrical component using electricity supplied with the deviation of the actual value.

2. The household appliance of claim 1, constructed as a household dishwasher, washing machine, or clothes dryer.

3. The household appliance of claim 1, wherein the characteristic of the electrical energy supply network is defined by a network voltage.

4. The household appliance of claim 1, wherein a characteristic of the electrical energy supply network is defined by a network frequency.

5. The household appliance of claim 1, wherein the member is the fluid heating device and the electrical component is at least one flow-through heater or a heat exchanger in a fluid circulation circuit of the household appliance to heat a fluid.

6. The household appliance of claim 5, wherein the fluid is a wash liquor fluid, or a washing fluid.

7. The household appliance of claim 5, wherein the member is the air drying device and the electrical component is at least one of a heating facility and a fan unit.

8. The household appliance of claim 7, wherein the air drying device is configured as a sorption drying apparatus which comprises at least one sorption container containing reversibly dehydratable sorption material.

9. The household appliance of claim 8, wherein the heating facility is configured as an air heater for desorption of the sorption material in the sorption container, said heating facility being provided, as viewed in an air flow direction, in at least one of two ways, a first way in which said heating facility is provided in an air guidance channel upstream of the sorption container, a second way in which said heating facility is provided in the sorption container upstream of the sorption unit containing the sorption material.

10. The household appliance of claim 8, wherein the sorption drying apparatus comprises at least one fan unit in its air guidance channel upstream of the sorption container, when viewed in an air flow direction, for generating a forced air flow into at least one inlet opening of the sorption container.

11. The household appliance of claim 1, wherein the controller is constructed to set the electrical component of the member in response to the control signal such that a heat energy generated by the member is lower than an upper limit value and/or higher than a lower limit value.

12. The household of claim 1, wherein the controller is operatively connected to the electrical component of the member such that a heat energy generated by the electrical component at the actual value of the at least one electrical characteristic of the electrical energy supply network substantially corresponds to a target heat energy at the target value of the characteristic of the electrical energy supply network.

13. The household of claim 12, wherein the target value is a rated value.

14. The household appliance of claim 1, wherein the controller is constructed to shorten a heating duration of a heating facility of the member and/or to increase a fan speed of a fan unit of the air drying device as a heat output brought about based on the actual value of the characteristic of the electrical energy supply network by the electrical components of the member becomes greater.

15. The household appliance of claim 5, wherein the controller is constructed to extend a heating duration of a heating facility of the member to a greater degree and/or to reduce a fan speed of a fan unit of the air drying device to a greater degree, the lower a heat output brought about based on the actual value of the characteristic of the electrical energy supply network by the electrical component of the air drying device.

16. The household appliance of claim 1, wherein the control/monitoring is operatively connected to a heating facility of the member such that a heating duration is shortened compared with a heating duration at target network voltage, when an actual electrical network voltage is greater than a target network voltage of the electrical energy supply network.

17. The household appliance of claim 16, wherein the target network voltage is a rated network voltage.

18. The household of claim 1, wherein the controller is operatively connected to a fan unit of the air drying device such that a fan speed of the fan unit is increased compared with a fan speed at target network voltage, when an actual electrical network voltage is greater than a target network voltage of the electrical energy supply network.

19. The household appliance of claim 18, wherein the target network voltage is a rated network voltage.

20. The household of claim 14, wherein the controller is operatively connected to a heating facility of the air drying device such that a heating duration is extended compared with a heating duration at target network voltage, when an actual electrical network voltage is lower than a target electrical network voltage of the electrical energy supply network.

21. The household appliance of claim 20, wherein the target network voltage is a rated network voltage.

22. The household of claim 1, wherein the controller is operatively connected to a fan unit of the air drying device such that a fan speed of the fan unit is reduced compared with a fan speed at target network voltage, when an actual electrical network voltage is lower than a target network voltage of the electrical energy supply network.

23. The household appliance of claim 22, wherein the target network voltage is a rated network voltage.

24. The household appliance of claim 1, wherein the controller comprises at least one phase leading edge control unit to adjust a heat output of a heating facility of the member.

25. The household appliance of claim 1, wherein the member has a heating facility having one or more heating circuits that can be activated or deactivated individually by means of the controller to adjust a heat output.

26. The household of claim 1, wherein the controller comprises at least one clock unit to time a heating facility of the member.

27. The household appliance of claim 1, wherein the controller is operatively connected to a heating facility of the member to increase a heating duration, and/or a heat output of the heating facility, as a speed of a fan unit of the air drying device brought about by an actual network frequency compared with a speed of the fan unit at a target network frequency of the electrical energy supply network becomes higher.

28. The household appliance of claim 27, wherein the target network frequency is a rated network frequency.

29. The household appliance of claim 1, wherein the controller is operatively connected to a heating facility of the member to reduce a heating duration, and/or the heat output of the heating facility, as a speed of a fan unit of the air drying device brought about by an actual network frequency compared with a speed of the fan unit at a target network frequency of the electrical energy supply network becomes lower.

30. The household appliance of claim 29, wherein the target network frequency is a rated network frequency.

31. The household appliance of claim 1, wherein the controller comprises at least one main control facility and at least one additional control facility, said additional control facility being operatively connected to a heating facility of the member and/or a fan unit of the air drying device for setting purposes.

32. A method for controlling a household appliance having a member selected from the group consisting of an air drying device and a fluid heating device, comprising the steps of:

connecting the member to an electrical energy supply network;

determining any deviation of an actual value of at least one characteristic of the electrical energy supply network from a target value; and providing a control signal to an electrical component of the member in response to the deviation, wherein the control signal adjusts an operating parameter of the electrical component essentially in a compensating manner to substantially maintain a desired target heat energy by the electrical component of the member while operating the electrical component using electricity supplied with the deviation of the actual value.

33. The method of claim 32 for operating a household dishwasher, washing machine, or clothes dryer.

34. A household appliance, comprising at least one member selected from the group consisting of an air drying device and a fluid heating device, the member being configured to use electricity from an electrical energy supply network; and at least one controller configured to detect any deviation of an actual value of at least one characteristic of the electrical energy supply network from a target value and to generate at least one control signal for setting an electrical component of the member in response to a detected deviation of the actual value, wherein the controller is configured to provide the control signal to the electrical component such that any deviation of the actual value from a target value is counteracted by adjusting an operating parameter of the electrical component to tend to maintain a desired target state of the electrical component while operating the electrical component using electricity supplied with the deviation of the actual value.

35. The household appliance of claim 34, wherein the desired target state is nominal heat load.

36. The household appliance of claim 34, wherein the desired target state is a standard operating condition when the electrical energy supply network is providing nominal voltage and/or frequency.

37. A domestic appliance comprising:

one or more electrical components of an air drying device and/or a liquid heating device, which are connected with an electrical energy supply mains, and at least one controller programmed to detect possible deviation of a respective actual value of at least one variable of the electrical energy supply mains from a target value, wherein the controller, based on a detected deviation of the actual value from the target value, generates at least one control signal for setting the one or more electrical components, and wherein the controller, based on the control signal: increases a fan rotational speed of a fan unit of the air drying device as heat output produced by the one or more electrical components of the air drying device and/or liquid heating device becomes greater based on the deviation of the actual value of the at least one variable of the electrical energy supply mains, or reduces the fan rotational speed of the fan unit of the air drying device as heating power produced by the one or more electrical components of the air drying device and/or liquid heating device becomes smaller based on the deviation of the actual value of the at least one variable of the electrical energy supply mains.

38. The domestic appliance according to claim 37, wherein the domestic appliance is a domestic dishwasher, a domestic washing machine, or a domestic laundry drier.

39. A method of controlling a domestic appliance, which comprises one or more electrical components of an air drying device and/or liquid heating device connected with an electrical energy supply mains, the method comprising:

detecting a deviation of a respective actual value of at least one variable of the electrical energy supply mains from a target value based on at least one controller, generating at least one control signal for setting the one or more electrical components by the controller based on the detected deviation of the respective actual value, increasing a fan rotational speed of a fan unit of the air drying device based on the control signal of the controller as heat output is produced by the one or more electrical components of the air drying device and/or liquid heating device based on the deviation of the actual value of the at least one variable of the electrical energy supply mains, or reducing the fan rotational speed of the fan unit of the air drying based on the control signal of the controller as the heat output produced by the one or more electrical components of the air drying device and/or liquid heating device based on the deviation of the actual value of the at least one variable of the electrical energy supply mains.

40. The method according to claim 39, wherein the domestic appliance is a domestic dishwasher, a domestic washing machine, or a domestic laundry drier.

* * * * *